United States Patent [19]

Dykstra

[11] 4,244,255

[45] Jan. 13, 1981

[54] ARTICLE SLOTTING APPARATUS

[75] Inventor: Peter Dykstra, North Haledon, N.J.

[73] Assignee: Park Metal, Prospect, N.J.

[21] Appl. No.: 56,153

[22] Filed: Jul. 10, 1979

[51] Int. Cl.[3] ..... B26D 5/10

[52] U.S. Cl. ..... 83/631; 83/697; 83/689; 83/686; 83/629

[58] Field of Search ..... 83/629, 631, 636, 627, 83/685, 686, 689, 697, 622, 620

[56] References Cited

U.S. PATENT DOCUMENTS

| | | | |
|---|---|---|---|
| 250,575 | 12/1881 | Rafelson | 83/631 X |
| 1,419,789 | 6/1922 | Webb | 83/631 X |
| 3,229,559 | 1/1966 | DeGain | 83/686 |
| 3,786,708 | 1/1974 | Mumper | 83/689 X |
| 3,863,531 | 2/1975 | Forschner et al. | 83/689 X |
| 3,956,952 | 5/1976 | Goettel et al. | 83/622 |

FOREIGN PATENT DOCUMENTS

| | | | |
|---|---|---|---|
| 618276 | 3/1927 | France | 83/629 |

*Primary Examiner*—Donald R. Schran

[57] ABSTRACT

An article slotting apparatus that includes a base member and a vertical support member, with a fixed platen connected at its rear edge area to the support member. Movable posts pass slidably through bores in the fixed platen and are connected at first ends to a lower platen and at their second, upper ends to a head platen. The posts, lower platen, and head platen can move in unision and are driven by a threaded shaft that is movable with respect to the support member. A slotting tool extends down from the lower platen and the space between the tool and the base member is relatively free of obstructions.

9 Claims, 7 Drawing Figures

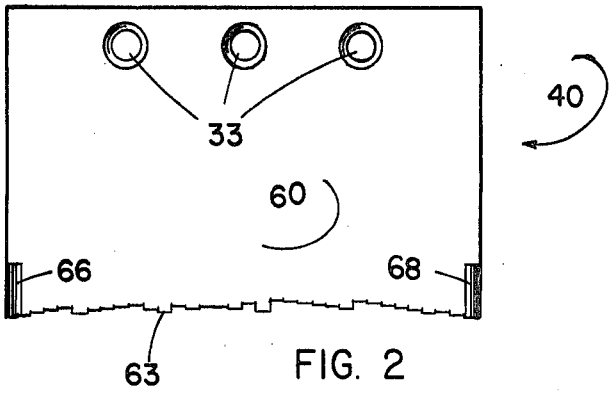
FIG. 2
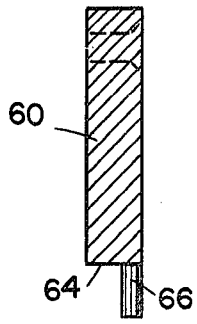
FIG. 3
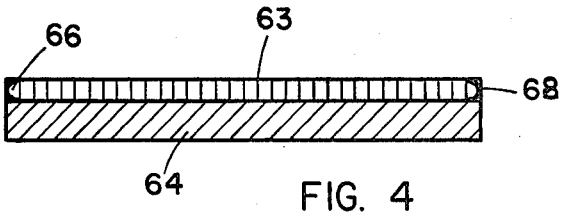
FIG. 4
FIG. 5
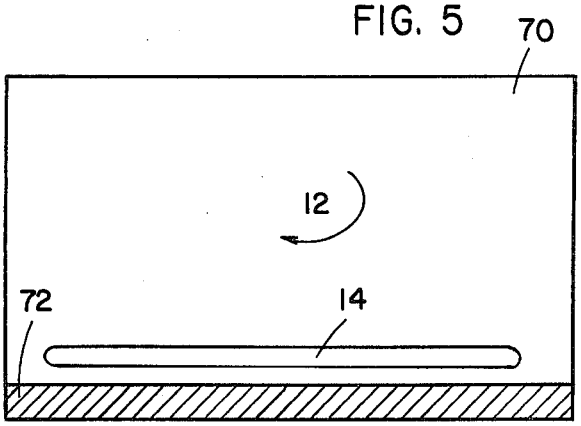
FIG. 6
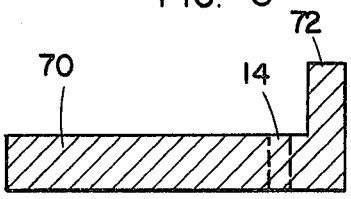

ARTICLE SLOTTING APPARATUS

BACKGROUND OF THE INVENTION

The present invention relates to a slotting apparatus, particularly to one that is manually operable.

While various slotting apparatus are known to the art, many such apparatus and other different types of apparatus suffer from a number of disadvantages. Illustrating, U.S. Pat. No. 4,132,101 to Abramson describes a crimping apparatus that is manually operable, such apparatus suffering from the drawback of having a pair of spaced-apart posts that prohibit or at least impair the ability to place a relatively large workpiece in the area under the movable parts thereof, so that the apparatus is limited to being used with a comparatively small workpieces, unless there is used a very large apparatus with a large span between such posts. Slotting devices known to the art can also suffer from this sort of disadvantage.

In contrast with the foregoing, the slotting apparatus of the present invention is simple, yet efficient, and is capable of being operated by even an untrained or unskilled operator.

An object of the present invention is to provide a highly efficient form of apparatus which can be quickly and easily operated.

Other objects, advantages and salient features of the present invention will become apparent from the following detailed description, which, taken in conjunction with the annexed drawings, discloses a preferred embodiment thereof.

BRIEF SUMMARY OF THE INVENTION

The foregoing objects are attained by providing a slotting apparatus which includes a slotted base member having attached thereto a vertical support member that comprises a vertical post portion and a generally horizontal yoke portion. Also included in the apparatus are a stationary platen connected to the vertical support member at the vertical post portion, which is located at the rear edge of the stationary platen, and the base member. The apparatus also includes a pair of spaced apart post members that are, at their respective central or interior portions, slidably disposed at apertures of the stationary platen which is disposed below the horizontal yoke or arm portion.

There is also included a movable platen having two spaced-apart bores, openings or apertures for receiving the lower ends of the post members in fixed relationship with the movable platen, which carries a slotting tool. The slidable platen is mounted between the base member and the stationary platen and is guided by the post members received at its bores. At their upper ends, the post members are secured to a head plate, which contains a central bore for receiving these upper ends. The lower platen (and the slotting tool thereon), the post members, and the upper head plate or platen can move in unison with respect to the stationary platen.

A threaded shaft or screw member that passes therethrough and is journaled in the head plate at an interior portion of the shaft. The horizontal yoke also comprises a bore in which a lower interior part of the threaded shaft is journaled, the lower end of the threaded shaft being journaled at the movable platen, such that, upon rotation of the threaded shaft, it is permitted to turn freely within the stationary platen and to move with respect to the stationary platen, also moving with the lower platen-post members - head plate assembly, which also results in the tool moving with respect to the base platen. Such rotation of the threaded shaft and its resulting motion with respect to the stationary platen, also results in the movable platen being moved with the threaded shaft and with respect to the base member and stationary platen, such that the movable platen, and therefore, the slotting tool, can be moved with respect to the base member. The slotting tool is aligned with and can be moved into the slot of the base member.

Becuase the vertical support member is located at the rear portion of the base and stationary platen, and therefore, the movable platen, and because the post members respective lower ends are located at some distance above the base member, there is an open area at the space between the base member and movable platen, thereby facilitating the introduction of relatively large work-pieces in this space, for slotting.

The slotting tool has, at its cutting edge, a concave profile with teeth-like projection and includes a flat ridge extending along the teeth arrangement.

DESCRIPTION OF THE DRAWING

FIG. 2 is a front elevation view of the slotting tool of the invention.

FIG. 3 is a side elevation view of the slotting tool of FIG. 2.

FIG. 4 is a bottom plan view of the slotting tool of FIG. 2.

FIG. 5 is a plan top view of the base plate of the apparatus of FIG. 1.

FIG. 6 is a side elevation view of the base plate of FIG. 5.

PREFERRED EMBODIMENT

Figure 1:
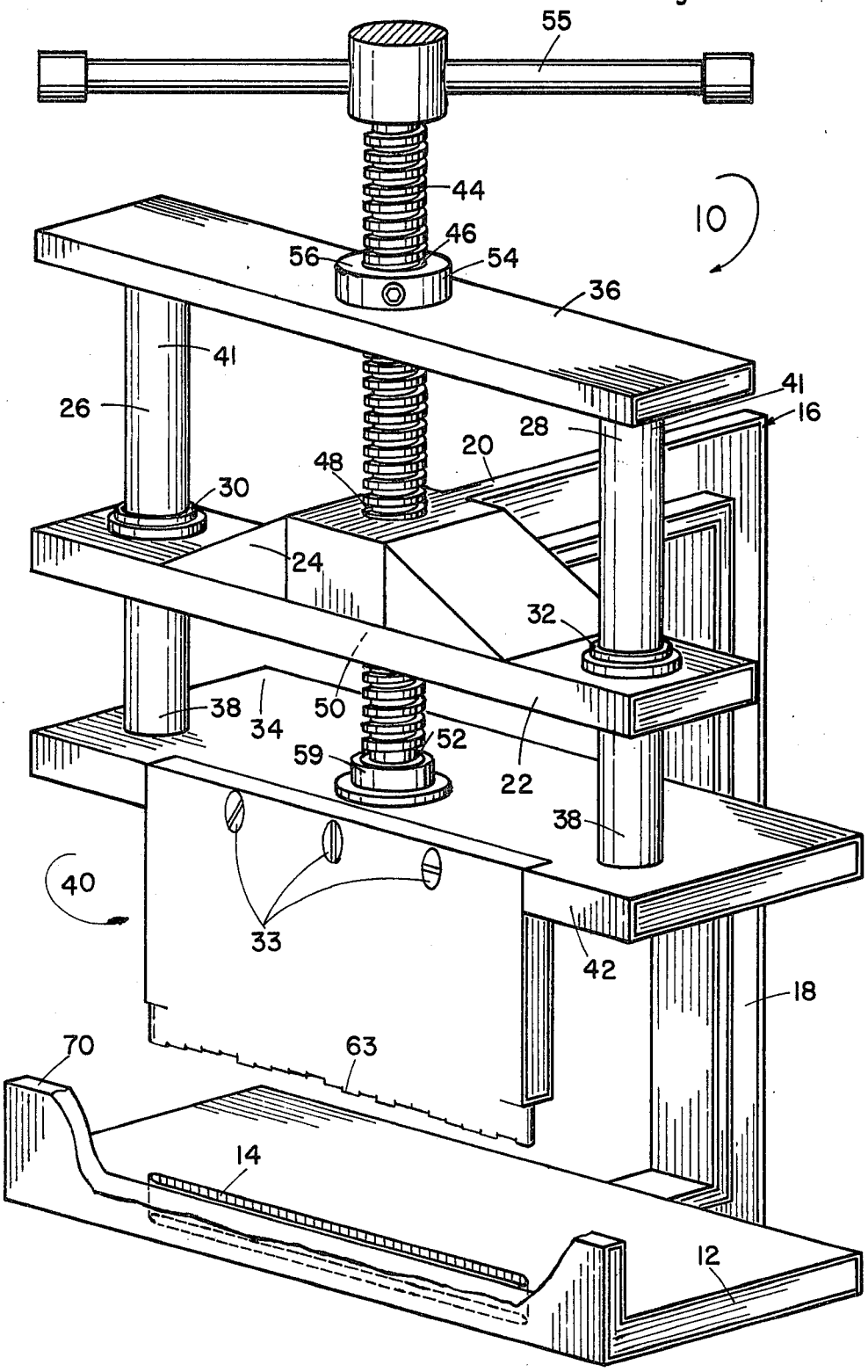
FIG. 1 is a perspective elevation view of the slotting apparatus according to a preferred embodiment of the invention.

Referring to FIG. 1, the slotting apparatus 10 of the present invention comprises a base or support member 12 that comprises a slot or aperture 14 that extends through at least part of and preferably through the entire, thickness of the base member, the apparatus 10 further including a vertical or upright support member 16 having a generally vertically disposed post member 18 and a generally horizontally disposed arm member 20 connected to the upright support member 16.

The apparatus 10 further comprises a fixed platen member 22 that is mounted on, for example, the vertical support member 16, e.g., by means of a back plate 24. The fixed platen member 22 is disposed so that the vertical support member 16 is located at the rear area or edge of the platen 22.

A pair of parallel, spaced apart post members 26, 28 are located at respective bores 30, 32 in the stationary platen member 22, the post members 26, 28 being in slidable relationship with the stationary lower platen 22 and vertically disposed.

The apparatus 10 also comprises a movable lower platen 34 and an upper platen or head plate 36 that are secured to opposite end regions 38 and 41 respectively, of the post members 26, 28. The lower platen 34, upper platen 36, and the post members 26, 28 are connected together and move in unison with respect to the fixed platen 22, the former being moved up and down along a vertical axis, with the post members 26, 28 sliding in the bores 30, 32 of the stationary platen 22. There is also included slotting tool element 40 that is attached (e.g., by screws 33) to the front edge 42 of the movable lower platen 34, the tool element 40 extending downward from the lower platen 34 into the space between such lower platen 34 and the base member 12, such space being open and free of obstruction except for the slotting tool element 40, with the lower ends 38 of the post members 26, 28 terminating at the lower platen 34 and not extending into the aforementioned space.

There is also included in the present apparatus 10 a threaded shaft or drive screw 44 which is received in bores 46, 48, 50 and 52 of, respectively, the upper platen 36, horizontal arm 20, stationary platen 22, and movable lower platen 34. The movable upper platen 36 comprises a collar element 54 which is flanged at its top 56 and bottom (not shown), so as to extend beyond the bore 46 of the upper platen 36. The collar 54 contains an internal thread that engages the thread of the drive screw 44, such that rotation of the shaft or screw 44 (which can include a cross-bar 55) causes the collar 54 to move with the screw 44 (up or down, depending on the direction in which the screw 44 is rotated), the collar 54, in turn, bearing on the upper platen 36 and moving such platen 36 with the screw 44.

The horizontal arm's bore 48 is threaded to complement the thread of the drive screw 44 and to move relative to the horizontal arm 20, so that the screw 44, when it is turned, moves upward or downward (depending on the direction in which the screw 44 is rotated) with respect to the horizontal arm 20, and because the arm is fixedly connected to the base member 12, the drive screw 44 also moves with respect to the base member 12.

Bore 50 of the stationary platen 22 can be of such size as to exceed the cross-sectional size of the screw 44, while the lower end of the screw 44 can be journaled in a journal housing connected to the lower platen 34 so that the lower platen 34 is carried with the lower end of the screw 44, thus permitting the controlled movement of the platen 34 and slotting tool 40. The drive screw 44 can, aside from or in conjunction with its engagement of the upper platen 36, engage the lower platen 34, as, for example, by means of a collar element 59.

Referring to FIGS. 2–4, the slotting tool element 40 comprises a relatively thick block portion 60 and a relatively narrow (viewed from the side) projection 62 at the edge 64 of which opposite the block portion 60 there is an array of teeth 63, the edge 64 and the arrangement of the teeth being generally arcuate, e.g., concave, as shown in FIG. 2. The teeth can be of irregular dimensions, as illustrated in FIG. 2, it being preferred that the ends 66, 68 be generally aligned with each other and project to substantially the same distance. Where the ends 66, 68 project to substantially the same distance when the slotting tool element 40 is lowered to a workpiece located between the tool element 40 and the base member 12, the projecting ends 66, 68 are the first part of the tool element 40 to engage the workpiece, these projecting ends serving to hold the workpiece in place during the initial part of the slotting operation and first penetrating the workpiece. The teeth 63 can be flat when viewed in profile, or can be of other suitable shape.

The base member 12 (FIGS. 5 and 6) can comprise a horizontal portion 70 that includes the slot or aperture 14 described above, and a vertical wall portion 72 at the front edge of the horizontal portion 70. The wall portion 72 can be used for locating the workpiece with respect to the tool element 40.

Figure 7:
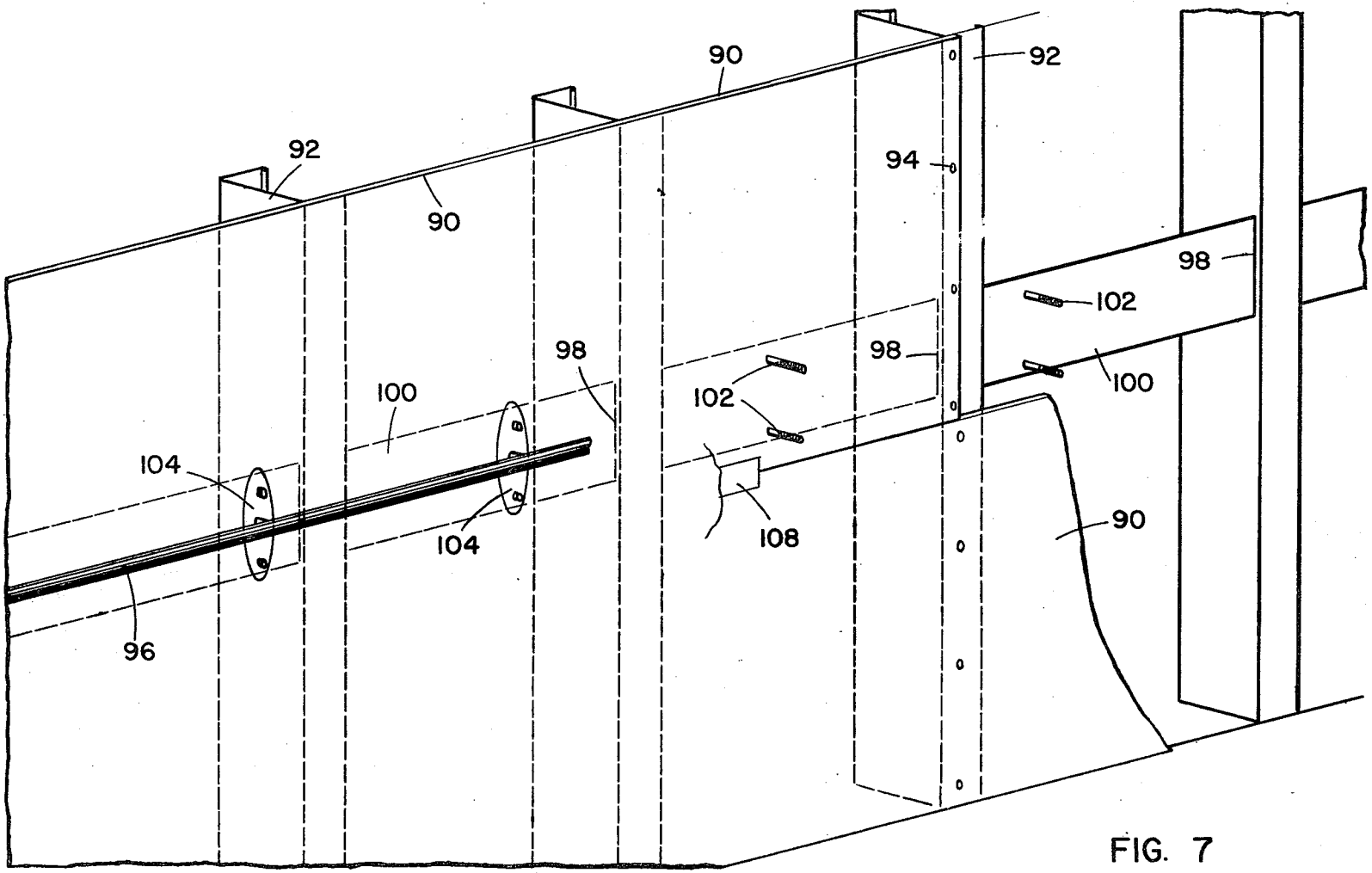
FIG. 7 is an example of the type of use to which the present invention can be put.

An example of the type of use to which the present invention can be put is shown in FIG. 7, where wall board 90 is installed on studs 92 that are of aluminum or other metal by means of fasteners 94, e.g., screws. To install a railing 96 on the wall, slots 98 are formed in the studs 92 with the apparatus 10 (FIG. 1) and panels 100 are installed so as to be located partly in the slots 98 and held by the studs 92, there being bolts or screws 102 that are installed in the panels 100 and that extend through the wall boards 90 so as to be available for connecting the railing 96 thereto. Where desired decorative or functional plates 104 can be mounted and held by the bolts or screws 102 with the railing 96 held in place by the plates 104. The seams of the boards 90 can be covered by paper tape 108 in known fashion.

I claim:

1. An article slotting aparatus, comprising:

(a) a support member, (b) an upright support member comprising a generally horizontally disposed arm member and a generally vertically disposed post member attached to said support member, (c) a fixed platen member that is mounted on said upright support member so that said post member is located at the rear area of said fixed platen member, said fixed platen member comprising spaced apart bores therein, (d) a movable lower platen member, (e) an upper platen member, (f) post members that are spaced apart and generally vertically disposed, said lower platen member being connected to said post members at first ends of said post members and said upper platen member being connected to said post members at opposite second ends of said post members, said post members being disposed at said bores of said fixed platen member so that said fixed platen member is slidably movable with respect to said post members, said upper platen member movable lower platen member, and post members being connected together and movable in unison, (g) a slotting tool element attached to the front edge of said movable lower platen member, said tool element extending downward from said lower platen member into the space between said support member and said lower platen member, said space being free of obstruction, and (h) a threaded drive shaft engaging at least one of said upper and lower platen member 2 and to be movable therewith with respect to said horizontally disposed arm member.

2. An article slotting apparatus as in claim 1, wherein said post members' respective lower ends terminate at said lower platen member.

3. An article slotting apparatus as in claim 1, wherein said support member having an aperture adapted to receive said slotting tool element.

4. An article slotting apparatus as in claim 1, wherein said slotting tool element comprises as viewed from the side, a relatively thick block portion and a relatively narrow projection extending from said block portion, said projection comprising a plurality of teeth.

5. An article slotting apparatus as in claim 4, wherein said teeth are located at the edge of said projection, which is generally arcuate in profile.

6. An article slotting apparatus as in claim 5, wherein said projection edge is concave.

7. An article slotting apparatus as in claim 4, wherein teeth are of irregular dimensions.

8. An article slotting apparatus as in claim 4, wherein said tool element comprises spaced apart end portions that are generally aligned with each other and project to substantially the same distance.

9. An article slotting apparatus as in claim 2, wherein said support member comprises a horizontal portion including said aperture and a vertical wall portion at the front edge of said horizontal portion.

* * * * *